US006955145B1

(12) United States Patent
McCabe et al.

(10) Patent No.: US 6,955,145 B1
(45) Date of Patent: Oct. 18, 2005

(54) METHODS AND APPARATUS FOR RECEIVING EXCESSIVE INPUTS IN A VCT SYSTEM

(75) Inventors: Thomas McCabe, Ithaca, NY (US); Danny R. Taylor, Freeville, NY (US); Earl Ekdahl, Ithaca, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 10/860,982

(22) Filed: Jun. 4, 2004

Related U.S. Application Data

(60) Provisional application No. 60/562,452, filed on Apr. 15, 2004.

(51) Int. Cl.[7] ..... F01L 1/34

(52) U.S. Cl. ..... 123/90.15; 123/90.16; 123/90.17; 123/90.31; 318/616; 91/364; 701/102; 701/105; 137/624.11; 137/624.13; 235/104

(58) Field of Search ..... 123/90.15–90.18, 123/90.27, 90.31; 464/1, 2, 160; 318/603, 318/607, 616–618; 91/361, 362, 364; 700/28, 700/31; 701/102, 105, 110, 115; 137/624.11, 137/624.13; 235/103, 103.5 R, 104

(56) References Cited

U.S. PATENT DOCUMENTS

| | | | | |
|---|---|---|---|---|
| 4,434,470 | A | 2/1984 | Thomas et al. | 364/565 |
| 5,002,023 | A | 3/1991 | Butterfield et al. | 123/90.15 |
| 5,245,968 | A * | 9/1993 | Kolias et al. | 123/480 |
| 5,345,909 | A * | 9/1994 | Fukui et al. | 123/406.58 |
| 5,736,633 | A * | 4/1998 | Magner et al. | 73/116 |
| 5,767,394 | A * | 6/1998 | Butts et al. | 73/116 |
| 6,232,739 | B1 * | 5/2001 | Krefta et al. | 318/652 |
| 6,247,434 | B1 | 6/2001 | Simpson et al. | 123/90.17 |

* cited by examiner

*Primary Examiner*—Thomas Denion
*Assistant Examiner*—Kyle M. Riddle
(74) *Attorney, Agent, or Firm*—Brown & Michaels, PC; Greg Dziegielewski

(57) ABSTRACT

A method that provides increased flexibility to measure dynamic range of a rotating system is provided. The method includes the steps of: providing a first rotating member; providing a second rotating member suitably engaged to the first rotating member; providing a set of sensors disposed to sense variations in characteristics along a circumference of the first member and the second member respectively; providing a controller for receiving information sensed by the sensors; determining a rate of rotation of the rotating members; selectively using the sensed information thereby at different rate of rotation different amount of the sensed information is used.

6 Claims, 6 Drawing Sheets

METHODS AND APPARATUS FOR RECEIVING EXCESSIVE INPUTS IN A VCT SYSTEM

REFERENCE TO RELATED APPLICATIONS

This application claims an invention which was disclosed in Provisional Application No. 60/562,452, filed Apr. 15, 2004, and entitled "METHODS AND APPARATUS FOR RECEIVING EXCESSIVE INPUTS IN A VCT SYSTEM The benefit under 35 USC § 119(e) of the United States provisional application is hereby claimed, and the aforementioned application is hereby incorporated herein by reference.

FIELD OF THE INVENTION

The invention pertains to the field of VCT systems. More particularly, the invention pertains to methods including interrupt switching and tooth skipping for receiving excessive inputs in a VCT system.

BACKGROUND OF THE INVENTION

The performance of an internal combustion engine can be improved by the use of dual camshafts, one to operate the intake valves of the various cylinders of the engine and the other to operate the exhaust valves. Typically, one of such camshafts is driven by the crankshaft of the engine, through a sprocket and chain drive or a belt drive, and the other of such camshafts is driven by the first, through a second sprocket and chain drive or a second belt drive. Alternatively, both of the camshafts can be driven by a single crankshaft powered chain drive or belt drive. Engine performance in an engine with dual camshafts can be further improved, in terms of idle quality, fuel economy, reduced emissions or increased torque, by changing the positional relationship of one of the camshafts, usually the camshaft which operates the intake valves of the engine, relative to the other camshaft and relative to the crankshaft, to thereby vary the timing of the engine in terms of the operation of intake valves relative to its exhaust valves or in terms of the operation of its valves relative to the position of the crankshaft.

Consideration of information disclosed by the following U.S. Patents, which are all hereby incorporated by reference, is useful when exploring the background of the present invention.

U.S. Pat. No. 5,002,023 describes a VCT system within the field of the invention in which the system hydraulics includes a pair of oppositely acting hydraulic cylinders with appropriate hydraulic flow elements to selectively transfer hydraulic fluid from one of the cylinders to the other, or vice versa, to thereby advance or retard the circumferential position on of a camshaft relative to a crankshaft. The control system utilizes a control valve in which the exhaustion of hydraulic fluid from one or another of the oppositely acting cylinders is permitted by moving a spool within the valve one way or another from its centered or null position. The movement of the spool occurs in response to an increase or decrease in control hydraulic pressure, $P_C$, on one end of the spool and the relationship between the hydraulic force on such end and an oppositely direct mechanical force on the other end which results from a compression spring that acts thereon.

U.S. Pat. No. 5,107,804 describes an alternate type of VCT system within the field of the invention in which the system hydraulics include a vane having lobes within an enclosed housing which replace the oppositely acting cylinders disclosed by the aforementioned U.S. Pat. No. 5,002,023. The vane is oscillatable with respect to the housing, with appropriate hydraulic flow elements to transfer hydraulic fluid within the housing from one side of a lobe to the other, or vice versa, to thereby oscillate the vane with respect to the housing in one direction or the other, an action which is effective to advance or retard the position of the camshaft relative to the crankshaft. The control system of this VCT system is identical to that divulged in U.S. Pat. No. 5,002,023, using the same type of spool valve responding to the same type of forces acting thereon.

U.S. Pat. Nos. 5,172,659 and 5,184,578 both address the problems of the aforementioned types of VCT systems created by the attempt to balance the hydraulic force exerted against one end of the spool and the mechanical force exerted against the other end. The improved control system disclosed in both U.S. Pat. Nos. 5,172,659 and 5,184,578 utilizes hydraulic force on both ends of the spool. The hydraulic force on one end results from the directly applied hydraulic fluid from the engine oil gallery at full hydraulic pressure, $P_S$. The hydraulic force on the other end of the spool results from a hydraulic cylinder or other force multiplier, which acts thereon in response to system hydraulic fluid at reduced pressure, $P_C$, from a PWM solenoid. Because the force at each of the opposed ends of the spool is hydraulic in origin, based on the same hydraulic fluid, changes in pressure or viscosity of the hydraulic fluid will be self-negating, and will not affect the centered or null position of the spool.

U.S. Pat. No. 5,289,805 provides an improved VCT method which utilizes a hydraulic PWM spool position control and an advanced control method suitable for computer implementation that yields a prescribed set point tracking behavior with a high degree of robustness.

In U.S. Pat. No. 5,361,735, a camshaft has a vane secured to an end for non-oscillating rotation. The camshaft also carries a timing belt driven pulley which can rotate with the camshaft but which is oscillatable with respect to the camshaft. The vane has opposed lobes which are received in opposed recesses, respectively, of the pulley. The camshaft tends to change in reaction to torque pulses which it experiences during its normal operation and it is permitted to advance or retard by selectively blocking or permitting the flow of engine oil from the recesses by controlling the position of a spool within a valve body of a control valve in response to a signal from an engine control unit. The spool is urged in a given direction by rotary linear motion translating means which is rotated by an electric motor, preferably of the stepper motor type.

U.S. Pat. No. 5,497,738 shows a control system which eliminates the hydraulic force on one end of a spool resulting from directly applied hydraulic fluid from the engine oil gallery at full hydraulic pressure, $P_S$, utilized by previous embodiments of the VCT system. The force on the other end of the vented spool results from an electromechanical actuator, preferably of the variable force solenoid type, which acts directly upon the vented spool in response to an electronic signal issued from an engine control unit ("ECU") which monitors various engine parameters. The ECU receives signals from sensors corresponding to camshaft and crankshaft positions and utilizes this information to calculate a relative phase angle. A closed-loop feedback system which corrects for any phase angle error is preferably employed. The use of a variable force solenoid solves the problem of sluggish dynamic response. Such a device can be designed to be as fast as the mechanical response of the spool valve, and certainly much faster than the conventional (fully hydraulic) differential pressure control system. The faster response allows the use of increased closed-loop gain, making the system less sensitive to component tolerances and operating environment.

U.S. Pat. No. 5,657,725 shows a control system which utilizes engine oil pressure for actuation. The system includes A camshaft has a vane secured to an end thereof for non-oscillating rotation therewith. The camshaft also carries a housing which can rotate with the camshaft but which is oscillatable with the camshaft. The vane has opposed lobes which are received in opposed recesses, respectively, of the housing. The recesses have greater circumferential extent than the lobes to permit the vane and housing to oscillate with respect to one another, and thereby permit the camshaft to change in phase relative to a crankshaft. The camshaft tends to change direction in reaction to engine oil pressure and/or camshaft torque pulses which it experiences during its normal operation, and it is permitted to either advance or retard by selectively blocking or permitting the flow of engine oil through the return lines from the recesses by controlling the position of a spool within a spool valve body in response to a signal indicative of an engine operating condition from an engine control unit. The spool is selectively positioned by controlling hydraulic loads on its opposed end in response to a signal from an engine control unit. The vane can be biased to an extreme position to provide a counteractive force to a unidirectionally acting frictional torque experienced by the camshaft during rotation.

U.S. Pat. No. 6,247,434 shows a multi-position variable camshaft timing system actuated by engine oil. Within the system, a hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,250,265 shows a variable valve timing system with actuator locking for internal combustion engine. The system comprising a variable camshaft timing system comprising a camshaft with a vane secured to the camshaft for rotation with the camshaft but not for oscillation with respect to the camshaft. The vane has a circumferentially extending plurality of lobes projecting radially outwardly therefrom and is surrounded by an annular housing that has a corresponding plurality of recesses each of which receives one of the lobes and has a circumferential extent greater than the circumferential extent of the lobe received therein to permit oscillation of the housing relative to the vane and the camshaft while the housing rotates with the camshaft and the vane. Oscillation of the housing relative to the vane and the camshaft is actuated by pressurized engine oil in each of the recesses on opposed sides of the lobe therein, the oil pressure in such recess being preferably derived in part from a torque pulse in the camshaft as it rotates during its operation. An annular locking plate is positioned coaxially with the camshaft and the annular housing and is moveable relative to the annular housing along a longitudinal central axis of the camshaft between a first position, where the locking plate engages the annular housing to prevent its circumferential movement relative to the vane and a second position where circumferential movement of the annular housing relative to the vane is permitted. The locking plate is biased by a spring toward its first position and is urged away from its first position toward its second position by engine oil pressure, to which it is exposed by a passage leading through the camshaft, when engine oil pressure is sufficiently high to overcome the spring biasing force, which is the only time when it is desired to change the relative positions of the annular housing and the vane. The movement of the locking plate is controlled by an engine electronic control unit either through a closed loop control system or an open loop control system.

U.S. Pat. No. 6,263,846 shows a control valve strategy for vane-type variable camshaft timing system. The strategy involves an internal combustion engine that includes a camshaft and hub secured to the camshaft for rotation therewith, where a housing circumscribes the hub and is rotatable with the hub and the camshaft, and is further oscillatable with respect to the hub and camshaft. Driving vanes are radially inwardly disposed in the housing and cooperate with the hub, while driven vanes are radially outwardly disposed in the hub to cooperate with the housing and also circumferentially alternate with the driving vanes to define circumferentially alternating advance and retard chambers. A configuration for controlling the oscillation of the housing relative to the hub includes an electronic engine control unit, and an advancing control valve that is responsive to the electronic engine control unit and that regulates engine oil pressure to and from the advance chambers. A retarding control valve responsive to the electronic engine control unit regulates engine oil pressure to and from the retard chambers. An advancing passage communicates engine oil pressure between the advancing control valve and the advance chambers, while a retarding passage communicates engine oil pressure between the retarding control valve and the retard chambers.

U.S. Pat. No. 6,311,655 shows multi-position variable cam timing system having a vane-mounted locking-piston device. An internal combustion engine having a camshaft and variable camshaft timing system, wherein a rotor is secured to the camshaft and is rotatable but non-oscillatable with respect to the camshaft is discribed. A housing circumscribes the rotor, is rotatable with both the rotor and the camshaft, and is further oscillatable with respect to both the rotor and the camshaft between a fully retarded position and a fully advanced position. A locking configuration prevents relative motion between the rotor and the housing, and is mounted within either the rotor or the housing, and is respectively and releasably engageable with the other of either the rotor and the housing in the fully retarded position, the fully advanced position, and in positions therebetween. The locking device includes a locking piston having keys terminating one end thereof, and serrations mounted opposite the keys on the locking piston for interlocking the rotor to the housing. A controlling configuration controls oscillation of the rotor relative to the housing.

U.S. Pat. No. 6,374,787 shows a multi-position variable camshaft timing system actuated by engine oil pressure. A hub is secured to a camshaft for rotation synchronous with the camshaft, and a housing circumscribes the hub and is rotatable with the hub and the camshaft and is further oscillatable with respect to the hub and the camshaft within a predetermined angle of rotation. Driving vanes are radially disposed within the housing and cooperate with an external surface on the hub, while driven vanes are radially disposed in the hub and cooperate with an internal surface of the housing. A locking device, reactive to oil pressure, prevents relative motion between the housing and the hub. A controlling device controls the oscillation of the housing relative to the hub.

U.S. Pat. No. 6,477,999 shows a camshaft that has a vane secured to an end thereof for non-oscillating rotation therewith. The camshaft also carries a sprocket that can rotate with the camshaft but is oscillatable with respect to the camshaft. The vane has opposed lobes that are received in opposed recesses, respectively, of the sprocket. The recesses have greater circumferential extent than the lobes to permit the vane and sprocket to oscillate with respect to one another. The camshaft phase tends to change in reaction to pulses that it experiences during its normal operation, and it is permitted to change only in a given direction, either to advance or retard, by selectively blocking or permitting the flow of pressurized hydraulic fluid, preferably engine oil, from the recesses by controlling the position of a spool within a valve body of a control valve. The sprocket has a passage extending therethrough the passage extending parallel to and being spaced from a longitudinal axis of rotation of the camshaft. A pin is slidable within the passage and is resiliently urged by a spring to a position where a free end of the pin projects beyond the passage. The vane carries a plate with a pocket, which is aligned with the passage in a predetermined sprocket to camshaft orientation. The pocket receives hydraulic fluid, and when the fluid pressure is at its normal operating level, there will be sufficient pressure within the pocket to keep the free end of the pin from entering the pocket. At low levels of hydraulic pressure, however, the free end of the pin will enter the pocket and latch the camshaft and the sprocket together in a predetermined orientation.

U.S. published patent application No. 20030230264 teaches a method for compensating for variable cam timing of an internal combustion engine is provided. The method includes: a) providing a periodical crank pulse signal; b) providing a periodical cam pulse signal; c) determining a segment, wherein the internal combustion engine speed induces a volatile change upon Zphase values; d) dividing the segment into sub-segments; and e) calculating Zphase values of a plurality of points within the sub-segments.

SUMMARY OF THE INVENTION

A method that provides increased flexibility to measure dynamic range of a rotating system is included herein.

In a apparatus having to rotating members rotating in substantial unison with each other via a coupling means such as a timing belt or chain, a controller disposed to receive updates from a set of sensors sensing a characteristic of the a circumference of each of the rotating members, a method is provided for increasing the number of updates at lower rotational speeds, and decrease the number of updates at higher rotational speeds.

A set of Input-Capture Methods for Embedded Control VCT Systems is provided whereby an optimal amount of information generated from a set of sensors is fed to a controller.

A method and apparatus are provided such that a flexible means for updating rates of information fed to embedded microprocessor(s) are provided.

A method and apparatus for selecting information generated by a set of associated pulse wheels amongst a pool of accessible information are provided.

A method that provides increased flexibility to measure dynamic range of a rotating system is included in which no existing hardware needs to be changed and only method suitable for applying computer program product to a machine is altered to optimize the selection of information for a microcontroller at a plurality of engine speeds.

Accordingly, a method is provided which includes the steps of: providing a first rotating member; providing a second rotating member suitably engaged to the first rotating member; providing a set of sensors disposed to sense variations in characteristics along a circumference of the first member and the second member respectively; providing a controller for receiving information sensed by the sensors; determining a rate of rotation of the rotating members; selectively using the sensed information thereby at different rate of rotation different amount of the sensed information is used.

DESCRIPTION OF THE PREFERRED EMBODIMENT

This section includes the descriptions of the present invention including the preferred embodiment of the present invention for the understanding of the same. It is noted that the embodiments are merely describing the invention. The claims section of the present invention defines the boundaries of the property right conferred by law.

Figure 1:
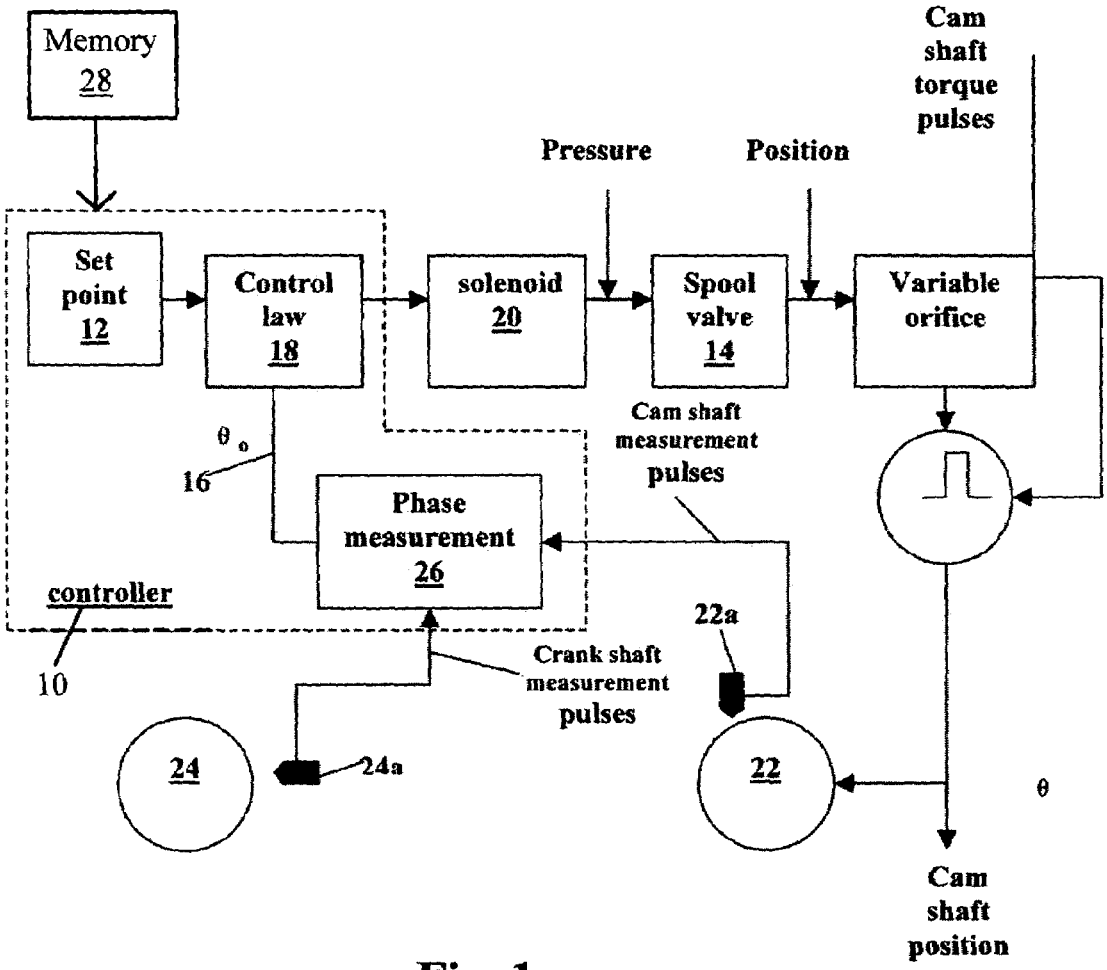
FIG. 1 shows a feedback loop for a VCT control system.

Referring to FIG. 1, a feedback loop 11 which may be suitable for the present invention is shown. It is noted that the present invention can be applicable to other structures as well. The control objective of feedback loop 11 is to have a spool valve in a null position. In other words, the objective is to have no fluid flowing between two fluid holding chambers of a phaser (not shown) such that the VCT mechanism at the phase angle given by a set point 12 with the spool 14 stationary in its null position. This way, the VCT mechanism is at the correct phase position and the phase rate of change is zero. A control computer program product which utilizes the dynamic state of the VCT mechanism is used to accomplish the above state.

The VCT closed-loop control mechanism is achieved by measuring a camshaft phase shift $\theta_0$ 16, and comparing the same to the desired set point 12. The VCT mechanism is in turn adjusted so that the phaser achieves a position which is determined by the set point 12. A control law 18 compares the set point 12 to the phase shift $\theta_0$ 16. The compared result is used as a reference to issue commands to a solenoid 50 to position the spool 14. This positioning of spool 14 occurs when the phase error (the difference between set point [r] 12 and phase shift $\theta_0$ 16 is non-zero.

The spool 14 is moved toward a first direction (e.g. right) if the phase error is negative (retard) and to a second direction (e.g. left) if the phase error is positive (advance). It is noted that the retarding with current phase measurement scheme gives a larger value, and advancing yields a small value. When the phase error is zero, the VCT phase equals the set point 12 so the spool 14 is held in the null position such that no fluid flows within the spool valve.

Camshaft and crankshaft measurement pulses in the VCT system are generated by camshaft and crankshaft pulse wheels 22 and 24, respectively. As the crankshaft (not shown) and camshaft (also not shown) rotate, wheels 22, 24 rotate along with them. The wheels 22, 24 possess teeth which can be sensed and measured by sensors according to measurement pulses generated by the sensors. The measurement pulses are detected by camshaft and crankshaft measurement pulse sensors 22*a* and 24*a*, respectively. The sensed pulses are used by a phase measurement device 26. A measurement phase difference is then determined. The phase between a cam shaft and a crankshaft is defined as the time from successive crank-to-cam pulses, divided by the time for an entire revolution and multiplied by 360 degree. The measured phase may be expressed as $\theta_0$ 16. This phase is then supplied to the control law 18 for reaching the desired spool position. A controller 10 may be defined as comprising control law 18 and phase measurement 26. Furthermore, controller 10 may have access to memory 28, which is used storing data and instructions. Memory 28 may be either internal to the controller 10, or alternatively external to the controller 10.

A control law 18 of the closed-loop 11 is described in U.S. Pat. No. 5,184,578 and is hereby incorporate herein by reference. A simplified depiction of the control law may be shown in FIG. 2. Measured phase 26 is subjected to the control law 18 initially at block 30 wherein a Proportional-Integral (PI) process occurs. PI process is the sum of two sub-processes. The first sub-process includes amplification; and the second sub-process includes integration. Measured phase is further subjected to phase compensation at block 32, where control signal is adjusted to increase the overall control system stability before it is sent out to drive the actuator, in the instant case, a variable force solenoid.

Figure 3:
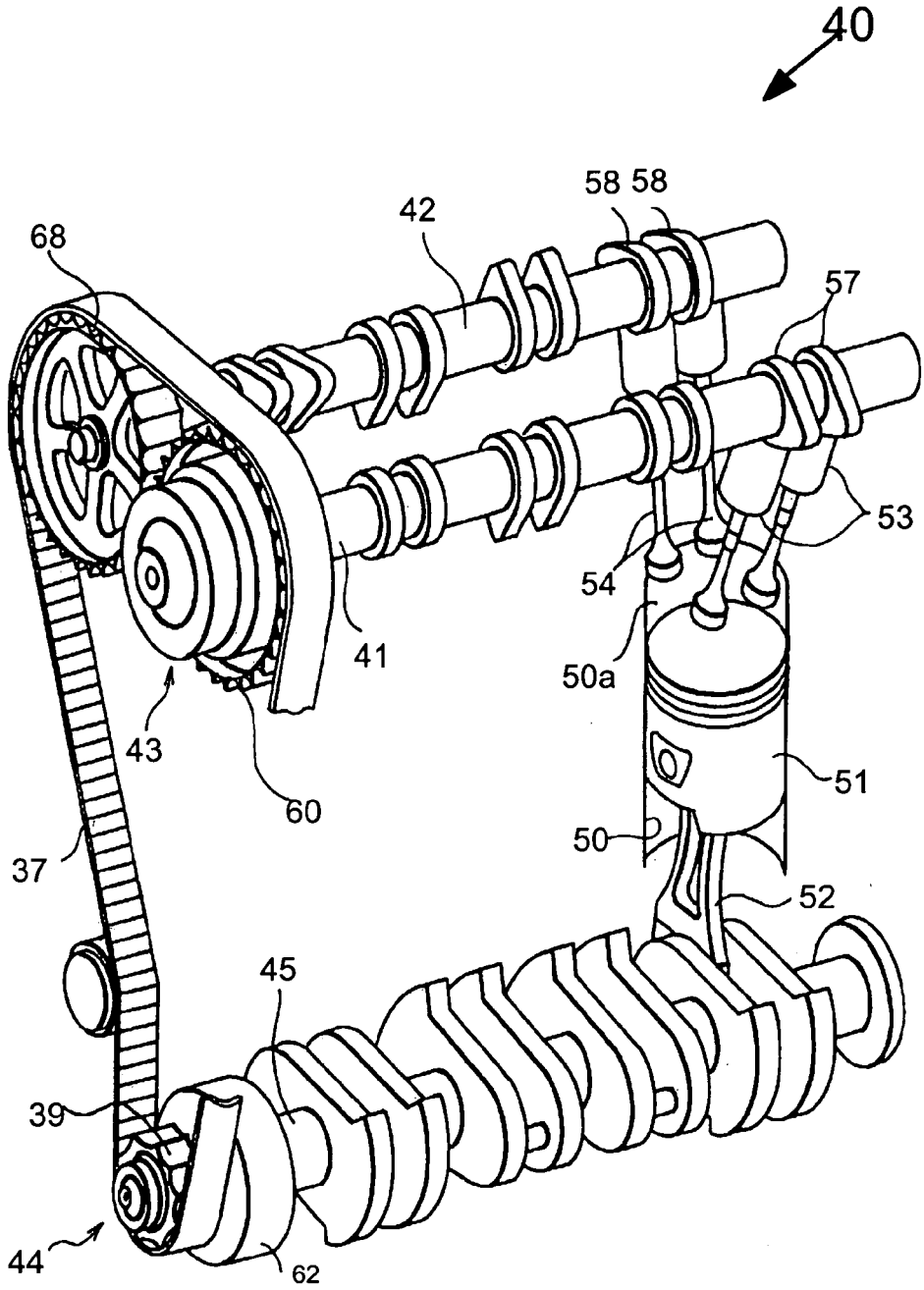
FIG. 3 shows a schematically showing of the structure of a variable cam timing (VCT) apparatus installed in a four-valve engine.

Referring to FIG. 3, a schematically showing of the structure of a variable cam timing (VCT) apparatus installed in a four-valve engine 40 mounted to a suitable vehicle (not shown) is shown. the engine 40 is provided with an intake cam shaft 41, an exhaust cam shaft 42, a first phaser 43 (hereinafter referred to simply as "first VCT") as a second actuating mechanism mounted to the intake cam shaft 41, a crank shaft 45, a second variable valve timing mechanism (not shown hereinafter referred to simply as "second VCT") as a first actuating mechanism mounted to the cam shaft 42, and the like.

The engine 40 has a cylinder block (not shown), a cylinder head (also not shown) securely laid on the cylinder block, and an oil pan (not shown) fixed to a lower side of the cylinder block. The oil pan stores oil therein, which is supplied to various portions of the engine 40 as lubricating oil and is also supplied to the aforementioned VCT's 43, as hydraulic control fluid. The cylinder block includes a plurality of cylinders 50 (only one shown) each having a combustion chamber 50*a*. The crank shaft 45 is rotatably supported by the cylinder block and a bearing cap (not shown). Each of the cylinders 50 has a piston 51 therein, which is connected to the crank shaft 45 via a connecting rod 52. In accordance with the combustion of air/fuel mixture in the combustion chamber 50*a*, the piston 51 moves in up-and-down directions, whereby the crank shaft 45 rotates.

The cylinder head includes a plurality of intake valves 53 and exhaust valves 54 corresponding to the respective cylinders 50. Further, the cylinder head is provided with intake ports (not shown) and exhaust ports (not shown) each communicating with the combustion chamber 50*a*. Each of the intake ports is connected to an intake passage (not shown), and each of the exhaust ports is connected to an exhaust passage (not shown). A throttle valve (not shown) disposed in an intake passage adjusts the amount of intake air introduced into the combustion chamber 50*a* from the intake port through the intake passage.

A crank pulley 39 is attached to the crank shaft 45 at its front end portion (at a left end portion in FIG. 3), and cam sprockets 60, 68 are attached to the cam shafts 41, 42 respectively at their front end portions. A timing belt 37 is hung around the crank pulley 39 and the cam sprockets 60, 68. Accordingly, torque is transmitted from the crank shaft 45 to the cam sprockets 60, 68 via the crank pulley 39 and the timing belt 37. The torque thus transmitted to the cam sprockets 60, 68 is further transmitted to the cam shafts 41, 42.

The intake and exhaust cam shafts 41, 42 have a plurality of pairs of cams 57, 58 respectively. The cams 57 or 58 constituting each pair are spaced apart from each other by a predetermined distance in the axial direction along the intake or exhaust cam shaft 41 or 42 respectively. The cams 57, 58 reciprocally drive the intake and exhaust valves 53, 54 in accordance with the cam shafts 41, 42 respectively. The intake and exhaust valves 53, 54 open or close the intake and exhaust ports in accordance with reciprocating movements of the cams 57, 58 respectively.

At different engine speeds, the crank and cam shafts rotate with different rates. The sensor wheels attached respectively to the crank and cam shafts rotate along with the shafts at different rates. By way of an example, referring back to FIG. 1 camshaft and crankshaft measurement pulse sensors 22*a* and 24*a* sense and generate pulses based upon the turning and the structure of camshaft and crankshaft pulse wheels 22 and 24. As can be seen, at lower engine speeds, less pulses are generate for a fixed time period, such as one period. A period can be any suitable time interval to delineate a relationship between the crank pulses and the cam pulses with one or more cam shaft engaging the crank shaft such as the relationship shown in FIG. 3. On the other hand, at higher engine speeds, more pulses are generated for a fixed time period. But the controller such as an engine control unit (ECU) or a VCT controller are general designed or disposed in such a way that an optimal number of pulse information is needed for a predetermined period such as the fixed time period. In other words, at low engine speeds, the controller may need more information than the sensors can provide, or alternatively the sensors may provide about enough information that the controller requires. This is because the sensors wheels are turning at the lower rate of revolution. But at high engine speeds, the sensor wheels are turning at a higher rate of revolution. Therefore, the sensors may provide more sensed information than that is required by the controller. As can be seen, the drawbacks include unnecessary processing time used by the controller for processing information that is not needed for a VCT system (at higher engine speeds). On the other hand, at low engine speeds, not enough information may be generated by the sensors for suitable controller processing. The present invention provides a set of methods for reconciling the above dilemma. In other words, the present invention provides at least one method for providing about enough information to the controller in such a way that an optimal amount of information provided to the controller. Information in the immediate above sentence is defined as information disposed to be generated by the pulse wheels on at least two shafts engaged together such as on the cam shaft(s) and the crank shaft of an internal combustion engine. The optimal amount of information is defined as the selected amount of information being selected from information disposed to be generated by the pulse wheels on the at least two shafts engaged together by a suitable means such as an engine timing chain.

The present invention provides Interrupt Switching, which is a flexible means for updating rates of information fed to a controller such as a set of embedded microprocessors, thereby causing the controller to run efficiently. Most microprocessors have the capability for a user to specify whether it is wanted for the timer-based interrupts associated therewith to occur on the rising pulse edges, the falling pulse edges, or both edges. The present invention provides a method and apparatus for switching the configuration of the microprocessor such that, at low engine speeds, more pulses can received; and, on the other hand, at high engine speed, less pulses amongst a set of selectable pulses are received. The pulse edges are defined as the pulses associated with the electrical pulse train such as pulses generated from sensors being triggered by pulse wheels. The present invention utilizes pulse wheels with teeth that have large "positive" areas, such that they are equal to the "negative" areas. It is noted that this choice equal areas is merely the convenience only. The present invention contemplates unequal areas between positive and negative areas.

Figure 4:
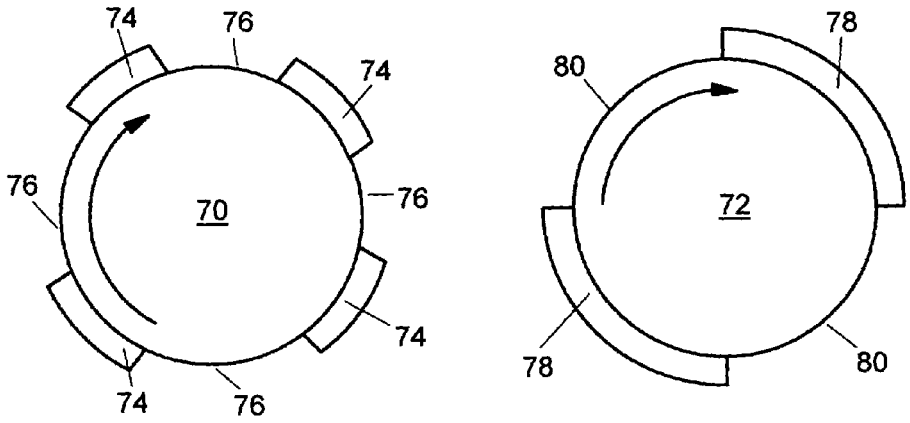
FIG. 4 shows a pair of different tooth wheels.

Referring to FIG. 4, a first tooth wheel 70 and a second tooth wheel 72 are provided. First tooth wheel 70 may be a pulse wheel affixed upon a cam shaft and associated with a cam sensor such as the sensor 22*a* of FIG. 1. Similarly, second tooth wheel 72 may be a pulse wheel affixed upon a crank shaft and associated with a crank sensor such as the sensor 24*a* of FIG. 1. As stated supra, we refer to the exemplified situation wherein the simplest calculations are needed. Therefore, the example chooses first tooth wheel 70 with 50% of the pulse-period being "positive" and 50% being "negative" is chosen as shown in the present figure. As can be seen first tooth wheel 70 possesses four evenly distributed teeth where the protruding portions or positive area is equal to the non-protruding portions or negative area circumferentially speaking. In other words, the arc 74 spanning the circumference of the first tooth wheel 70 is equal to the arc 76 spanning the circumference of first tooth wheel 70 as well.

Similarly, for second tooth wheel 72, 50% of the pulse-period being "positive" and 50% being "negative" is chosen as shown in the present figure. As can be seen second tooth wheel 72 possesses two evenly distributed teeth where the protruding portions or positive area is equal to the non-protruding portions or negative area circumferentially speaking. In other words, the arc 78 spanning the circumference of the second tooth wheel 72 is equal to the arc 80 spanning the circumference of second tooth wheel 72 as well.

First tooth wheel 70 may be a pulse wheel affixed upon a cam shaft. Second tooth wheel 72 may be a pulse wheel affixed upon a crank shaft. The crank shaft and cam shaft are associated or engaged together via an engaging means such as a chain (not shown).

However, in the present invention it is contemplated that the distribution of "positive" to "negative" areas does not have to be equal, nor does the spacing of the teeth need to equally distributed around the circumference of the pulse wheel. The reason for trying to achieve near equal "positive" and "negative" spacing on the pulse wheel in the above example is important in that a more evenly distributed updates for providing data to the controller is achieved.

In the situation where the positive and negative going edges of the teeth are significantly close together, there is not much benefit to be gained, because the two updates are so close that they seem as one to the controller.

Lets examine the case of a 4-toothed pulse wheel, 70 with equally distributed and equally spaced teeth (50%+50%). At low rotational speeds, the controller is set to trigger on both the rising and falling edges of the pulse wheel in that information of both the rising and falling edges can be received and used by the controller without causing unnecessary hardship for the controller. In the example of a 4-tooth wheel 70, 8 updates/revolution is provided to the controller. In the case where we are using logic within the processor that runs at a fixed frequency, this would provide more frequent updates, for improved closed-loop control. As rotational speeds increase, the update rate increases proportionally, so the controller begins to get a significantly higher frequency of updates. This, in most cases, is more than what is required by the processor, and may in fact exceed the resolution for the capabilities of the computer program products associated with the controller. In addition, too much of the controller's time may be require for the handling to handling of these updates. Therefore, the present invention provides a method and associated apparatus for switching the controller to trigger only on falling edges (or rising edges), thereby reducing the number of updates/rev. by half. The net result is that only 4 updates are received by the processor in our exemplified case.

Figure 5:
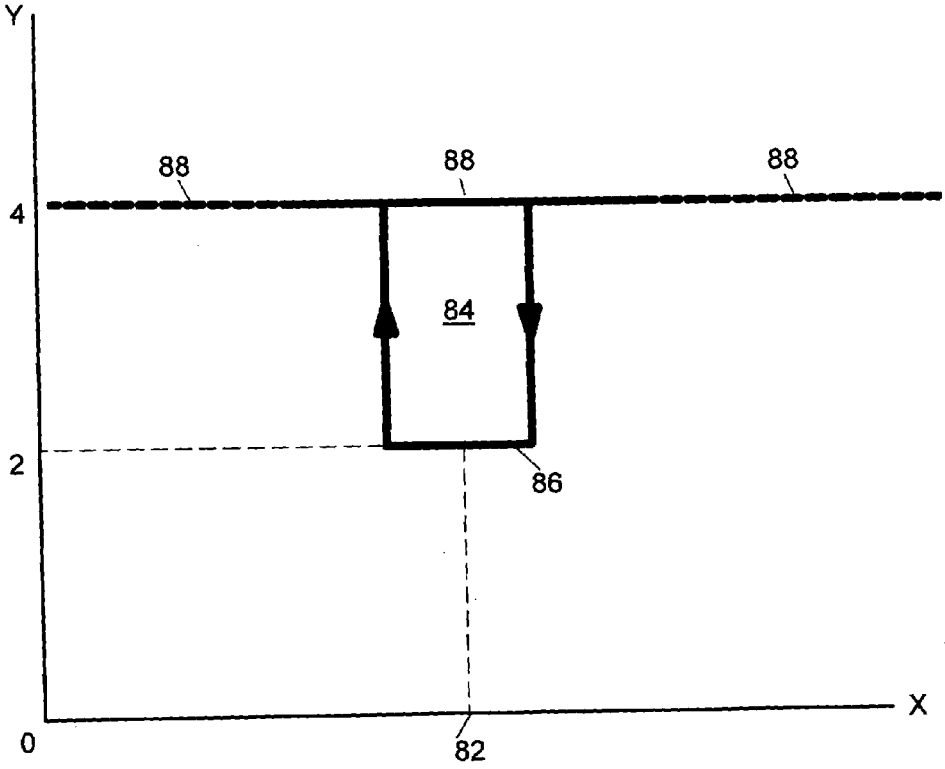
FIG. 5 shows a hysteresis band around a speed point.

Referring to FIG. 5, at the threshold where the triggering transition of the triggering between both edges and only falling edges occurs, any necessary adjustment to the controller calculations in order to maintain accuracy may be provided. As shown, the x-coordinate stands for engine speed, and the y coordinate stands for the number of interrupts where the controller receives selective information from the sensors.

In the neighborhood of point 82 only two interrupts occur for the controller to receive sensed information. A hysteresis band 84 provided around point 82 such that a sufficient margin is provided for preventing undue switching or toggling between 2 interrupts and 4 interrupts. For example, point 82 may stand for engine speed at 1,500 RPM. An interrupt switching hysteresis band of 200 RPM is provided. Line segments 88 denotes the controller receiving 4 interrupts per crank revolution; and line segments 86 denotes the controller receiving 2 interrupts per crank revolution. As can be seen, the present invention contemplates using more than one hysteresis band for some type of engines having a range of speeds (RPMs).

The present invention provides interrupt switching that allows complete shut off (or non-selection) of all eligible interrupts to the controller that are not needed. At higher engine operating speeds, by working with only falling edges sufficient information can be provided to the controller without, for example, the rising edges of the input signal of the sensed information for inputting into the controller. In other words, the rising edges of the input signal are not used for interrupting the execution of the program product for handling by the controller. Thus, in situations where controller execution and timing are critical, interrupt switching can provide dynamic range of measurement as well as efficiency within the controller.

As an example, in an embedded VCT control system, a 4-tooth pulse wheel on the camshaft may be chosen, and a 2-tooth pulse wheel on the crankshaft chosen as well. Both pulse wheels have 50% spacing of "positive" and "negative" tooth areas, and the teeth are equally spaced around the circumference of the pulse wheel (as shown in FIG. 4). Since the camshafts in engines spin ½ the speed of the crankshaft, twice the number of teeth on the camshaft pulse wheel is used so as to keep the frequency of the pulses between the crankshaft and the camshaft equal. For phase measurement methods, refer to U.S. Pat. No. 5,184,578 and U.S. Pat. No. 5,289,805 for details. Both U.S. Pat. No. 5,184,578 and U.S. Pat. No. 5,289,805 are hereby incorporated herein by reference. At low engine speeds, the controller is set to trigger interrupts on both the rising and falling edges so as to provide 4 updates/crank-rev. Above a predefined speed threshold, the controller is switched to trigger only on falling edges so as to provide us with 2 updates/crank-rev, or with two updates per crank revolution. In addition, at the speed threshold, phase calculations are slightly modified to reflect the different update rates.

Controller can be further modified or improved such that some tooth wheel is wholly ignored by the controller. In other words, at least one tooth may be totally ignored or skipped. Tooth Skipping is defined as something involving the use of a pulse wheel with more teeth than necessary for proper update rate, whereby at least one tooth is skipped and not used.

An example would be to have an 8-tooth wheel, which is disposed to be sensed by a sensor, as well as being disposed to respond to an interrupt on every tooth. However, it may be advantageous, within the program product of a controller such as an embedded processor, to only use the time information from every-other tooth, which is sufficient for an optimal controller system, whereby an effective 4-tooth wheel is recognized by the controller but in fact 8 teeth exist on the wheel.

Figure 6:
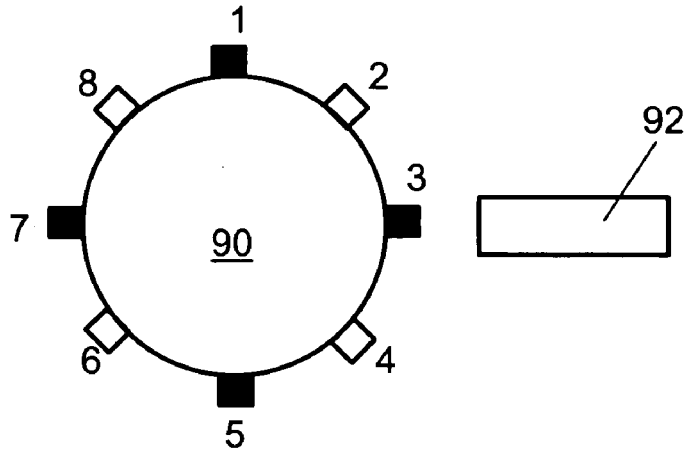
FIG. 6 shows a tooth wheel of the present invention.

The above can be shown be referring to FIG. 6, wherein an 8 tooth pulse wheel 90 is depicted. The teeth on wheel 90 are number numerically from 1–8. As can be seen, if every other tooth is skipped, a result may be achieved in which only teeth number 1, 3, 5, and 7 are command by the controller to be sensed by a sensor 92.

Furthermore, in order to increase the robustness of the method of the present invention, adding a once/rev or index tooth (in the form of either an added tooth, or a missing tooth) is desirable, in that one can keep track of when the start of a new revolution occurs. This will give us a chance to periodically verify that we are skipping the correct tooth. This can be shown by referring to FIGS. 7*a*–7*b*, wherein an 8+1 tooth wheel 94 and an 8–1 tooth wheel 96 are depicted.

Figure 7A:
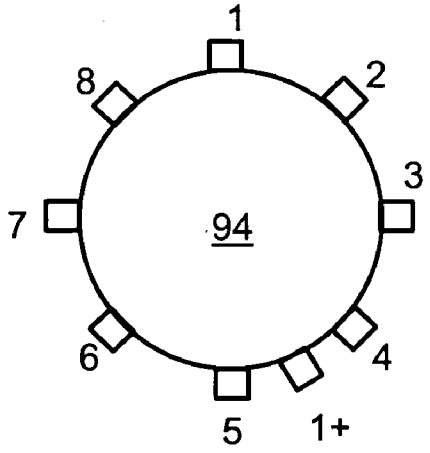
FIG. 7A shows a tooth wheel with a first index (tooth) of the present invention.

Referring to FIG. 7*a*, an added tooth +1 or the $9^{th}$ tooth is provided as shown.

Figure 7B:
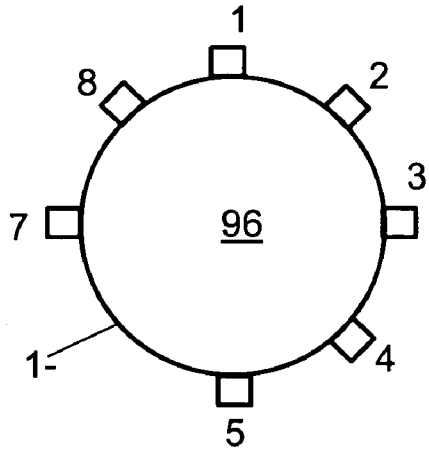
FIG. 7B shows a tooth wheel with a second index (missing tooth) of the present invention.

Referring to FIG. 7*b*, a missing tooth is provided by having the region where the $6^{th}$ tooth is located in wheel 94 of FIG. 7*a* free of any tooth.

The present inventions incorporates tooth skipping and interrupt switching into a unitary whole to thereby enable a controller to achieve an optimal state in controlling a system having two rotating, engagable members, where each member has characteristics that can be censored by suitable types of sensors. Similar to Interrupt Switching, the tooth skipping method of the present invention can be used to increase the number of updates at lower rotational speeds, and decrease the number of updates at higher rotational speeds. This can be beneficial because the frequency of updates can be matched with the resolution in the controller, such that the most accurate calculations can be made. Also, by using a pulse wheel with more teeth than is intended for counting regarding VCT system, flexibility is provided to try various schemes of tooth counts. For example, by using a 24 -tooth wheel, you can count 1, 2, 3, 4, 6, 8, 12, or 24 teeth per revolution. Those combinations all divide evenly into 24. By changing the number of counted teeth, the dynamic range of measuring the rotating system is extended because the resolution within the processor is always optimized in that in a neighborhood of any different speed the space between the selected teeth can be optimized.

As can be seen, the use of an index tooth can aid the method of tooth skipping because one feature that Tooth Skipping method does not provide is the ability to shut off extraneous interrupts going to the microcontroller. Tooth skipping triggers interrupts into the microcontroller in all cases, however, it requires the software interrupt handler to acknowledge when an extraneous pulse has occurred, and it will need to discard that information. Conversely, it will also need to acknowledge when a needed tooth occurs, and use it properly in it calculations. Therefore, the benefit of having an index tooth can be seen here, because the index can be used to verify that the microcontroller is discarding the correct tooth. If a synchronization problem occurs, and the microcontroller does count the wrong tooth, an error will occur within the calculations.

The present invention Tooth Skipping further provides increased flexibility to measure dynamic range of a rotating system. In the case where we are not concerned with extra interrupts to the microcontroller, Tooth Skipping can be useful in development work. In other words, we can experiment with the system by choosing different sets of teeth on the wheel. For example, if we have an engine with an 8 tooth wheel on it, but we want to evaluate the performance of the system with a 4 tooth wheel, we can skip alternative teeth on the wheel, and the controller will perform as it would with an actual 4 tooth wheel. Furthermore, the hardware Interrupt Switching could also apply here, with the same example: i.e. a 4 tooth wheel with 8 edges, being switched to only 4 edges for testing purposes.

An example of this applied to embedded control system for Variable Cam Timing, a 36-tooth wheel is used on the crankshaft, and an 8-tooth wheel is used on each of the camshafts. There is also a missing tooth on the crankshaft wheel to provide us with a once/rev index mark. Working from the 36-tooth crankshaft pulse wheel, we used Tooth Skipping to achieve an effective 4 pulses/crank-rev. We count 1 tooth, and then skip the following 8 teeth, and repeat, giving us 4 positive counts per revolution. We do not skip any teeth on the camshaft, in this case. For details on the phase measurement method, refer to U.S. Pat. Nos. 5,184,578 and 5,289,805. This method of the present invention provides us with our desired configuration of 4 teeth on the crankshaft, and 8 teeth on the camshafts. In some recent development work, we have used to our advantage the ability to count only 2 teeth/rev, or only two teeth per revolution. and thus we can work with updates at a slower rate. One advantage using this scheme is that we can work with different combinations without changing the pulse wheel or hardware, only working with different method suitable for applying computer program product to a machine to count different combinations of teeth.

Figure 8:
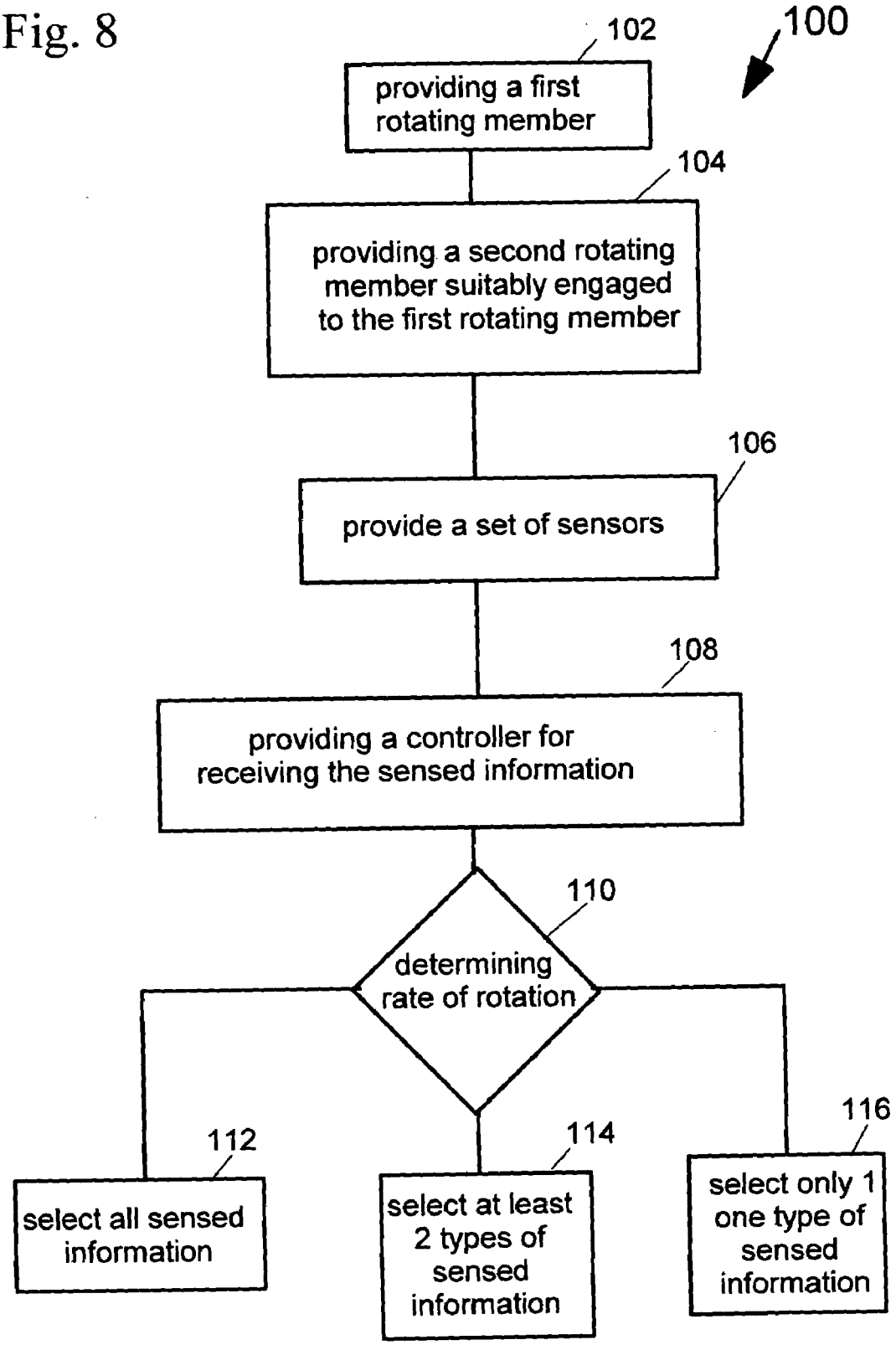
FIG. 8 shows a flowchart of the present invention.

Referring to FIG. 8, a flow chart 100 depicting a method suitable for implementing in a computer product is depicted. The method includes the providing of a first rotating member 102 and the providing a second rotating member suitably engaged to the first rotating member 104. The method further includes the providing a set of sensors disposed to sense variations in characteristics along a circumference of the first member and the second member respectively. A controller is used for receiving information sensed by the sensors. A determination is made regarding a rate of rotation of the rotating members. The method provides selectively using the sensed information thereby at different rate of rotation different amount of the sensed information is used.

A plurality of points each point having a substantial neighborhood points associated with each of the plurality of points defines a neighborhood such as a range of rotation rate. The range of rotation rate may be a set of engine speeds. Therefore, based upon a determination on the rate of rotation of the members, different approach can be made to optimally use information by either feeding the sensed information to the controller and let the controller determine which part of the information is used, or alternatively by selecting only that part of the information for feeding to the controller in that the controller do not need to process the information that is not required.

The selectively use some of the characteristics on the circumference of the first or second members respectively based on the rate of rotation of the members causes the controller to process the optimal amount of information. For example, at middle level rate of rotation, the controller may use only some of the sensed information in that neither all possible sensed information, nor only one type of sensed information are used. The information may represent just some of the characteristics of the rotating members such as the rising edge or falling edge of a sensor wheel, or skipping some of the teeth of the sensor wheel.

In another aspect, the selectively use of the sensed information may include the selection of all the information representing all the characteristics on the circumference of the first or second members. For example, at low engine speed, the controller may need all the information available that can sensed by the sensors.

In yet another aspect, the selectively use of the sensed information may include the selection of only the information representing one of the characteristics on the circumference of the first or second members. In other words, the selecting at least one of the characteristics on the circumference of the first or second members may be used for higher rates of rotation.

As can be appreciated, the use of index marks are needed for improved performance of the present invention (see supra). Therefore by providing a first index point on the circumference of the first member, and by providing a second index point on the circumference of the second member, the controller is disposed to have a better or more robust disposition in determining the correct action such as determining whether a tooth the controller thinks is actually the tooth in the real world.

In addition, the controller may not need all of the sensed information. Therefore, if unnecessary information is provided to the controller, optimal state may not be achieved. For example, more time may be wasted by the controller in determining which piece of information is needed and which is not. Thus, the present invention contemplates providing the controller with only information that it needs at various rates of rotation of the members. This may involve a second low level controller to provided the controller with only the sensed information that the controller needs.

Alternatively, the controller may be reprogrammed to received different subsets of information at different rates of rotation. In other words, by altering only the computer program product associated with the controller, no altering of the associated hardware is required.

Figure 2:
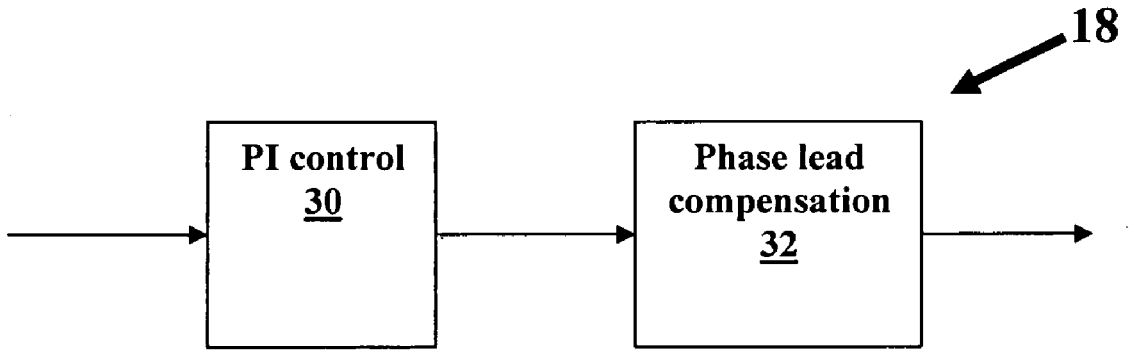
FIG. 2 shows one of the embodiments of the control law in FIG. 1.

One embodiment of the invention is implemented as a program product for use with a computer system such as, for example, the schematics shown in FIGS. 1–2 and described below. The program(s) of the program product defines functions of the embodiments (including the methods described below with reference to FIG. 8 and can be contained on a variety of signal-bearing media. Illustrative signal-bearing media include, but are not limited to: (i) information permanently stored on in-circuit programmable devices like PROM, EPPOM, etc; (ii) information permanently stored on non-writable storage media (e.g., read-only memory devices within a computer such as CD-ROM disks readable by a CD-ROM drive); (iii) alterable information stored on writable storage media (e.g., floppy disks within a diskette drive or hard-disk drive); (iv) information conveyed to a computer by a communications medium, such as through a computer or telephone network, including wireless communications, or a vehicle controller of an automobile. Some embodiment specifically includes information downloaded from the Internet and other networks. Such signal-bearing media, when carrying computer-readable instructions that direct the functions of the present invention, represent embodiments of the present invention.

In general, the routines executed to implement the embodiments of the invention, whether implemented as part of an operating system or a specific application, component, program, module, object, or sequence of instructions may be referred to herein as a "program". The computer program typically is comprised of a multitude of instructions that will be translated by the native computer into a machine-readable format and hence executable instructions. Also, programs are comprised of variables and data structures that either reside locally to the program or are found in memory or on storage devices. In addition, various programs described hereinafter may be identified based upon the application for which they are implemented in a specific embodiment of the invention. However, it should be appreciated that any particular program nomenclature that follows is used merely for convenience, and thus the invention should not be limited to use solely in any specific application identified and/or implied by such nomenclature.

The following are terms and concepts relating to the present invention.

It is noted the hydraulic fluid or fluid referred to supra are actuating fluids. Actuating fluid is the fluid which moves the vanes in a vane phaser. Typically the actuating fluid includes engine oil, but could be separate hydraulic fluid. The VCT system of the present invention may be a Cam Torque Actuated (CTA) VCT system in which a VCT system that uses torque reversals in camshaft caused by the forces of opening and closing engine valves to move the vane. The control valve in a CTA system allows fluid flow from advance chamber to retard chamber, allowing vane to move, or stops flow, locking vane in position. The CTA phaser may also have oil input to make up for losses due to leakage, but does not use engine oil pressure to move phaser. Vane is a radial element actuating fluid acts upon, housed in chamber. A vane phaser is a phaser which is actuated by vanes moving in chambers.

There may be one or more camshaft per engine. The camshaft may be driven by a belt or chain or gears or another camshaft. Lobes may exist on camshaft to push on valves. In a multiple camshaft engine, most often has one shaft for exhaust valves, one shaft for intake valves. A "V" type engine usually has two camshafts (one for each bank) or four (intake and exhaust for each bank).

Chamber is defined as a space within which vane rotates. Chamber may be divided into advance chamber (makes valves open sooner relative to crankshaft) and retard chamber (makes valves open later relative to crankshaft). Check valve is defined as a valve which permits fluid flow in only one direction. A closed loop is defined as a control system which changes one characteristic in response to another, then checks to see if the change was made correctly and adjusts the action to achieve the desired result (e.g. moves a valve to change phaser position in response to a command from the ECU, then checks the actual phaser position and moves valve again to correct position). Control valve is a valve which controls flow of fluid to phaser. The control valve may exist within the phaser in CTA system. Control valve may be actuated by oil pressure or solenoid. Crankshaft takes power from pistons and drives transmission and camshaft. Spool valve is defined as the control valve of spool type. Typically the spool rides in bore, connects one passage to another. Most often the spool is located on center axis of rotor of a phaser.

Differential Pressure Control System (DPCS) is a system for moving a spool valve, which uses actuating fluid pressure on each end of the spool. One end of the spool is larger than the other, and fluid on that end is controlled (usually by a Pulse Width Modulated (PWM) valve on the oil pressure), full supply pressure is supplied to the other end of the spool (hence differential pressure). Valve Control Unit (VCU) is a control circuitry for controlling the VCT system. Typically the VCU acts in response to commands from ECU.

Driven shaft is any shaft which receives power (in VCT, most often camshaft). Driving shaft is any shaft which supplies power (in VCT, most often crankshaft, but could drive one camshaft from another camshaft). ECU is Engine Control Unit that is the car's computer. Engine Oil is the oil used to lubricate engine, pressure can be tapped to actuate phaser through control valve.

Housing is defined as the outer part of phaser with chambers. The outside of housing can be pulley (for timing belt), sprocket (for timing chain) or gear (for timing gear). Hydraulic fluid is any special kind of oil used in hydraulic cylinders, similar to brake fluid or power steering fluid. Hydraulic fluid is not necessarily the same as engine oil. Typically the present invention uses "actuating fluid". Lock pin is disposed to lock a phaser in position. Usually lock pin is used when oil pressure is too low to hold phaser, as during engine start or shutdown.

Oil Pressure Actuated (OPA) VCT system uses a conventional phaser, where engine oil pressure is applied to one side of the vane or the other to move the vane.

Open loop is used in a control system which changes one characteristic in response to another (say, moves a valve in response to a command from the ECU) without feedback to confirm the action.

Phase is defined as the relative angular position of camshaft and crankshaft (or camshaft and another camshaft, if phaser is driven by another cam). A phaser is defined as the entire part which mounts to cam. The phaser is typically made up of rotor and housing and possibly spool valve and check valves. A piston phaser is a phaser actuated by pistons in cylinders of an internal combustion engine. Rotor is the inner part of the phaser, which is attached to a cam shaft.

Pulse-width Modulation (PWM) provides a varying force or pressure by changing the timing of on/off pulses of current or fluid pressure. Solenoid is an electrical actuator which uses electrical current flowing in coil to move a mechanical arm. Variable force solenoid (VFS) is a solenoid whose actuating force can be varied, usually by PWM of supply current. VFS is opposed to an on/off (all or nothing) solenoid.

Sprocket is a member used with chains such as engine timing chains. Timing is defined as the relationship between the time a piston reaches a defined position (usually top dead center (TDC)) and the time something else happens. For example, in VCT or VVT systems, timing usually relates to when a valve opens or closes. Ignition timing relates to when the spark plug fires.

Torsion Assist (TA) or Torque Assisted phaser is a variation on the OPA phaser, which adds a check valve in the oil supply line (i.e. a single check valve embodiment) or a check valve in the supply line to each chamber (i.e. two check valve embodiment). The check valve blocks oil pressure pulses due to torque reversals from propagating back into the oil system, and stop the vane from moving backward due to torque reversals. In the TA system, motion of the vane due to forward torque effects is permitted; hence the expression "torsion assist" is used. Graph of vane movement is step function.

VCT system includes a phaser, control valve(s), control valve actuator(s) and control circuitry. Variable Cam Timing (VCT) is a process, not a thing, that refers to controlling and/or varying the angular relationship (phase) between one or more camshafts, which drive the engine's intake and/or exhaust valves. The angular relationship also includes phase relationship between cam and the crankshafts, in which the crank shaft is connected to the pistons.

Variable Valve Timing (VVT) is any process which changes the valve timing. VVT could be associated with VCT, or could be achieved by varying the shape of the cam or the relationship of cam lobes to cam or valve actuators to cam or valves, or by individually controlling the valves themselves using electrical or hydraulic actuators. In other words, all VCT is VVT, but not all VVT is VCT.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. A method of altering the quantity of information sent to a controller at various engine speeds comprising the steps of:

a) sensing at least one protrusion having a first leading edge and a second trailing edge on a circumference of a first rotating member;

b) sensing at least one protrusion having a first leading edge and a second trailing edge on a circumference of a second rotating member attached to the first rotating member;

c) generating a first signal representing the protrusion of the first rotating member;

d) generating a second signal representing the protrusion of the second rotating member;

e) sending the first signal and the second signal to a controller;

f) determining a rate of rotation of the first rotating member and the second rotating member and generating a phase difference between the first rotating member and the second rotating member using the first signals and the second signals generated;

g) comparing the phase difference between the first rotating member and the second rotating member to a fixed phase measurement;

h) altering the phase difference between the first rotating member and the second rotating member;

i) comparing the rate of rotation to a threshold rate of rotation at which either the leading edge or the trailing edge is reported; and j) determining whether the threshold rate of rotation has been reached;

wherein when the threshold rate of rotation has been reached, a first signal and a second signal are generated for either the leading edge or the trailing edge of the protrusions of the first rotating member and the second rotating member.

2. The method of claim 1, wherein the first rotating member is the camshaft and the second rotating member is the crankshaft.

3. The method of claim 1, wherein the threshold rate of rotation is at high engine speeds.

4. A method of altering the quantity of information sent to a controller at various engine speeds comprising the steps of:

a) sensing a first plurality of teeth on a circumference of a first rotating member;

b) sensing a second plurality of teeth on a circumference of a second rotating member attached to the first rotating member;

c) generating a first signal representing the first plurality of teeth of the first rotating member;

d) generating a second signal representing the second plurality of teeth of the second rotating member;

e) sending the first signal and the second signal to a controller;

f) determining the rate of rotation of the first rotating member and the second rotating member and generating a phase difference between the first rotating member and the second rotating member using the first signals and the second signals generated;

g) comparing the phase difference between the first rotating member and the second rotating member to a fixed phase measurement;

h) altering the phase difference between the first rotating member and the second rotating member;

i) comparing the rate of rotation to a threshold rate of rotation at which the first plurality of teeth and the second plurality of teeth are sensed and the first signal and the second signal are generated for at least one tooth sensed and skipped for at least one other tooth sensed of the first rotating member and the second rotating member; and j) determining whether the threshold rate of rotation has been reached;

wherein when the threshold rate of rotation has been reached, the first plurality of teeth and the second plurality of teeth are sensed and a first signal and a second signal are generated for at least one tooth and skipped for at least one other tooth of the first rotating member and the second rotating member.

5. The method of claim 4, wherein the first rotating member is the camshaft and the second rotating member is the crankshaft.

6. The method of claim 4, wherein the threshold rate of rotation is at high engine speeds.

* * * * *